US007187333B2

(12) United States Patent
Yoneya et al.

(10) Patent No.: US 7,187,333 B2
(45) Date of Patent: Mar. 6, 2007

(54) ANTENNA DEVICE

(75) Inventors: Akira Yoneya, Akita (JP); Yoshiaki Imano, Akita (JP); Akemi Kato, Akita (JP); Tsutomu Ito, Akita (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 24 days.

(21) Appl. No.: 10/879,348

(22) Filed: Jun. 30, 2004

(65) Prior Publication Data

US 2005/0068248 A1 Mar. 31, 2005

(30) Foreign Application Priority Data

Sep. 30, 2003 (JP) ..... P.2003-342105

(51) Int. Cl.
*H01Q 1/40* (2006.01)

(52) U.S. Cl. ..... 343/713; 343/872; 343/700 MS

(58) Field of Classification Search ..... 343/702, 343/711–713, 715, 872, 873, 905, 700 MS, 343/906, 878

See application file for complete search history.

(56) References Cited

U.S. PATENT DOCUMENTS 4,992,801 A * 2/1991 Saito et al. ..... 343/713
5,298,894 A * 3/1994 Cerny et al. ..... 340/870.02
5,585,809 A * 12/1996 Yajima et al. ..... 343/713
5,885,679 A * 3/1999 Yasue et al. ..... 428/57

FOREIGN PATENT DOCUMENTS

JP 2001-68912 3/2001

* cited by examiner

*Primary Examiner*—Michael C. Wimer
(74) *Attorney, Agent, or Firm*—Whitham, Curtis, Christofferson & Cook, P.C.

(57) ABSTRACT

An antenna device that can surely prevent water from coming into the part where the transmission table is introduced and allows the number of parts to be reduced so that the cost can be reduced. The antenna device includes an antenna module that receives radio waves transmitted from a satellite, a cover member having a sufficient internal space to store the antenna module and its bottom opened, and a bottom plate to close the open bottom of the cover member. The transmission cable is connected to the antenna module. The transmission cable is inserted from the hole provided at the cover member and sealed by a seal material including silicon resin in the hole. The bottom plate is made of a metal plate and a magnet plate and the magnet plate has projections to position the magnet. After the bottom plate is attached, a composite resin material is filled and the cover member has its bottom side sealed.

10 Claims, 4 Drawing Sheets

ANTENNA DEVICE

BACKGROUND OF THE INVENTION

1. Field of the Invention

The invention relates to an antenna device that receives radio waves transmitted from a satellite, and more particularly, to an improvement to a waterproof structure therefor.

2. Description of the Related Art

Conventional systems for directing and guiding the course of an automobile to the driver of the automobile, so-called car navigation systems have come into widespread use. In such a car navigation system, the present position of the automobile is specified based on the speed or traveled distance of the automobile, while the present position is also specified based on positional information obtained from radio waves transmitted and received from GPS satellites in order to improve the positioning accuracy.

In recent years, in the United States of America and other countries, digital radio broadcasting has come to be provided using radio waves transmitted from an artificial satellite. An antenna is necessary in a digital radio receiving system to receive the digital radio broadcasting, and a so-called DAB (Digital Audio Broadcasting) antenna is used.

Radio waves from a satellite are often in a high frequency band and have high directivity. Therefore, in the car navigation system and digital radio receiving system described above, the receiving antenna must be attached to the top surface (such as the roof) of the automobile in order to receive the radio waves from the satellite in a good receiving condition.

Therefore, an antenna device that receives radio waves from a satellite must have high weather and water resistance.

As shown in FIG. 6, a conventional GPS receiving antenna includes an antenna module 100 that receives radio waves transmitted from a GPS satellite, and the antenna module 100 is stored in an internal space formed by a cover member 101. The cover member 101 has a hole 101*a* on its one side, and a transmission cable 102 leading from the antenna module 100 is externally extended from the hole 101*a*. A first waterproof packing 103 is attached to the transmission cable 102 in the position of the hole 101*a*.

The cover member 101 is provided with a second waterproof packing 104 to seal the open side as the antenna module 100 is stored and then a bottom plate 105 supporting the second waterproof packing 104. The second waterproof packing 104 and the bottom plate 105 are fixed to the cover member 101 by four screws 106.

The bottom plate 105 is provided with a magnet 107 for securing the GPS receiving antenna to the roof of the automobile. At the outer side of the bottom plate 105, a sheet type member 108 of for example PET (polyethylene terephthalate) is adhesively provided in order to hide the heads of screws 106 for improved appearance and prevent the roof of the automobile from being damaged by the bottom plate 105. The sheet type member 108 has a transparent part In the center, and an indicator tag 109 is provided between the sheet and the bottom plate 105. The model number of the GPS receiving antenna and the like in the indicator tag 109 can be recognized through the transparent part of the sheet type member 108. In the conventional GPS receiving antenna described above, the water resistance is secured by the first waterproof packing 103 and the second waterproof packing 104 of silicon rubber or the like, and the antenna module 100 stored in the cover member 101 is protected As described above, in the conventional GPS antenna, the water resistance is secured by the first waterproof packing 103 and the second waterproof packing 104. The bottom plate 105 and the four screws 106 are provided to support and fix the second waterproof packing 104 (see Japanese Patent Laid-Open No. 2001-68912).

In this way, the conventional GPS antenna requires a large number of parts and there is a limit to the reduction of the parts and the assembly cost, and it is difficult to reduce the overall cost.

SUMMARY OF THE INVENTION

It is an object of the present invention to provide an antenna device that allows the number of parts and the cost to be reduced and has high water resistance to surely prevent water from coming into the antenna device.

In order to achieve the above described object, the antenna device according to the invention includes an antenna module that receives a radio wave transmitted from a satellite, a cover member having a sufficient internal space to store the antenna module and its bottom surface opened, and a bottom plate that closes the opened bottom surface of the cover member. The antenna module is connected with a transmission cable. The transmission cable is inserted through a hole provided In the cover member and sealed inside the hole by a seal material including silicon resin.

In the antenna device according to the invention, the transmission cable is inserted through the hole provided in the cover member and the part where the transmission cable is introduced is sealed by the seal material including silicon resin inside the hole, so that water can surely be prevented from coming into the device. For example, no gap is generated in the seal material with time, and water can be prevented from coming in for a long period of time.

In the antenna device according to the invention, water can surely be prevented from coming into the part where the transmission cable is introduced. The antenna device that has a reduced number of parts and allows the cost to be reduced can be provided.

BRIEF DESCRIPTION OF THE DRAWINGS

FIG. 5(*b*) is a schematic sectional view showing the process of soldering a transmission cable;

FIG. 5(*c*) is a schematic sectional view showing the process of filling silicon resin;

FIG. 5(*d*) is a schematic sectional view showing the process or attaching a metal plate;

FIG. 5(*e*) is a schematic sectional view showing the process of attaching a magnet;

FIG. 5(*f*) is a schematic sectional view showing the process of forming a seal part.

DETAILED DESCRIPTION OF THE PREFERRED EMBODIMENTS

Now, a GPS receiving antenna will be described as an application of the invention to an antenna device.

Figure 1:
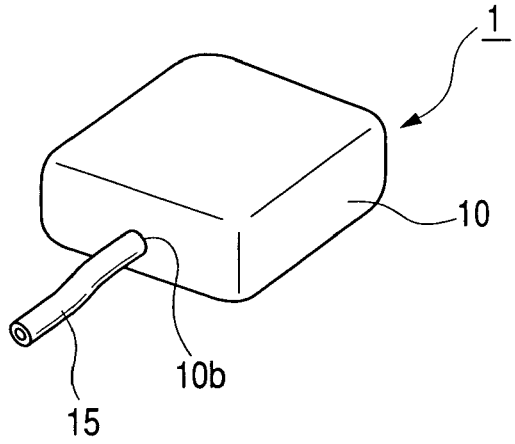
FIG. 1 is a general perspective view of a GPS receiving antenna.
Figure 2:
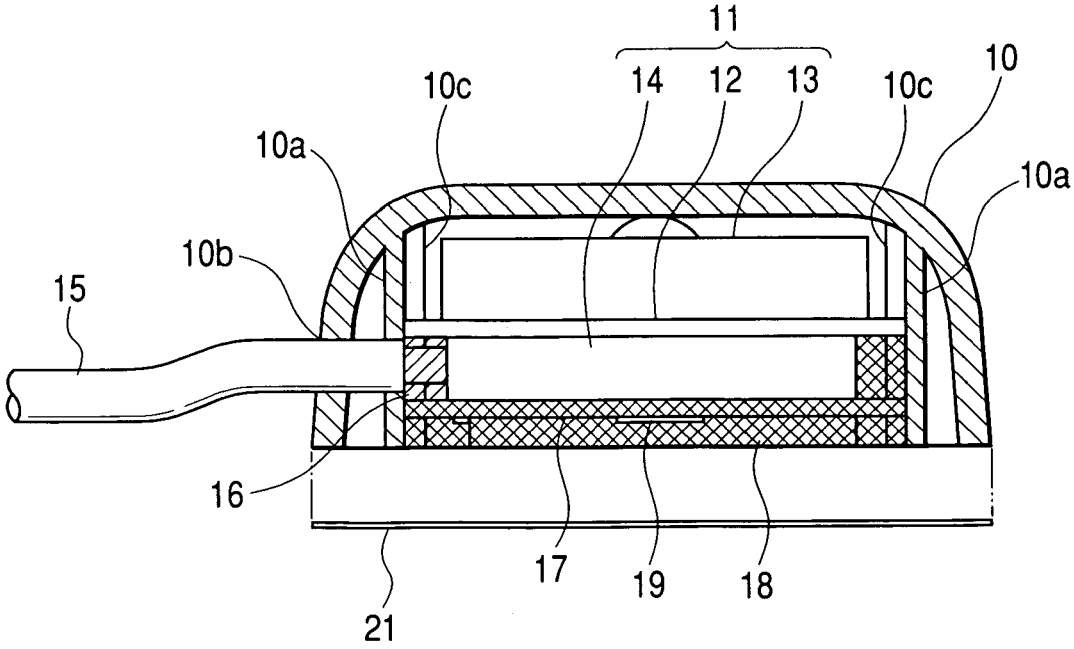
FIG. 2 is a schematic sectional view of the GPS receiving antenna.

As shown in FIGS. 1 and 2, the GPS receiving antenna 1 according to an embodiment includes a cover member 10 generally formed in a substantially cubic shape. The cover member 10 is produced by injection-molding a resin material having desired weather and water resistance and has an internal space for storing the elements or the GPS receiving antenna 1. The cover member 10 has one surface opened and generally has a bowl shape.

In the internal space of the cover member 10, an antenna module 11 for receiving radio waves transmitted from GPS satellites is stored. In the antenna module 11, a receiving antenna 13 is provided on a substrate 12. A shield case 14 storing the peripheral circuit of the receiving antenna 13 is provided on the backside of the substrate 12 (on the opposite side to the surface with the receiving antenna 1).

The substrate 12 has notches 10*d* in four locations of the outer edge part. The antenna module 11 has an integrally formed upright part 10*a* in an approximately circular shape from the inner surface of the cover member 10 to support the peripheral edge of the substrate 12, and engagement members 10*c* are provided on the upright part 10*a* in the positions of the substrate 12 corresponding to the notches 10*d* fitted to the engagement members 10*c* and provisionally fixed to the internal space of the cover member 10.

A transmission cable 15 to output a signal included in received radio waves is extended from the antenna module 11. The transmission cable 15 is inserted through a hole 10*b* formed on one side of the cover member 10 and externally extended from the cover member 10. In this way, the transmission cable 15 is extended from the hole 10*b* and therefore higher water resistance can be secured than for example the case of extending the cable through a notch.

Figure 3:
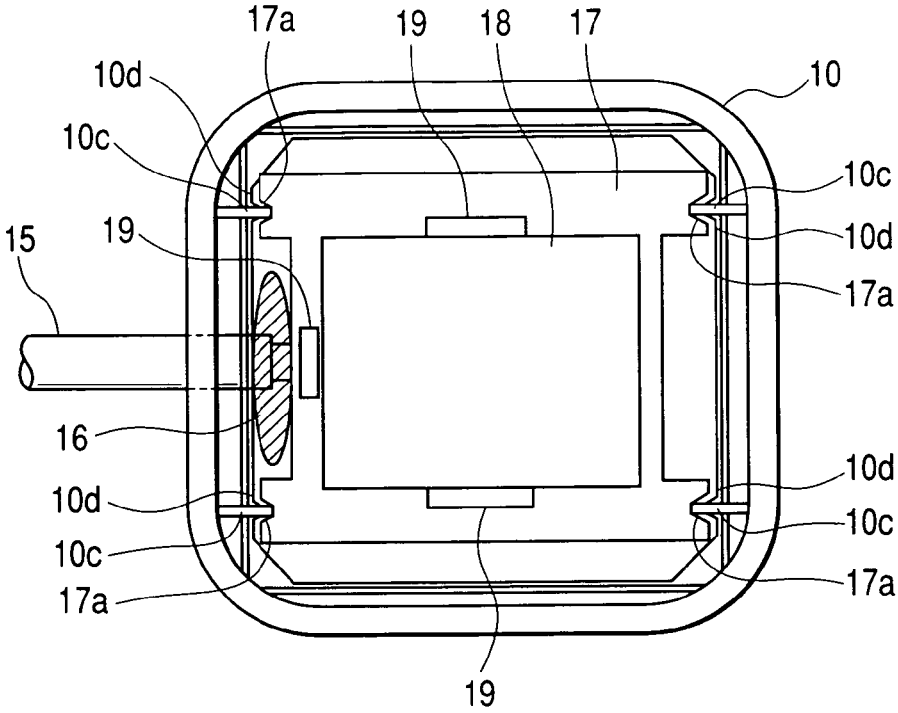
FIG. 3 is a bottom view of the GPS receiving antenna before a seal part is formed.

According to the embodiment, a waterproof seal of a seal material is provided on the inner side of the hole 10*b*. FIG. 3 is a view of the state before a sealing part is formed by filling a composite resin material as sill be described. On the inner side of the hole 10*b*, a seal material 16 as silicon resin fills the periphery of the transmission cable 15. The seal material 16 fills the gap between the transmission cable 15 and the hole 10*b* in order to prevent water from coming in through the gap. The silicon resin is inpoured into the vicinity of the transmission cable 15 and the hole 10*b* in liquid form. When the silicon resin is inpoured, the silicon resin is also inpoured into the gap between the transmission cable 15 and the hole 10*b*. Subsequently, the silicon resin in liquid form becomes hardened by a heating or the like. As shown in FIG. 3, a magnet 18 is provided at the bottom (on the open side of the cover member 10) of the antenna module 11 through a metal plate 17. The magnet 16 is positioned by the protrusions 19 on the metal plate and firmly connected to the shield case 14 by the magnetic force. As a result, the metal plate 17 is attached as it covers the shield case 14. The metal plate 17 is provided with four notches 17*a*, and the notches 17*a* are fitted to the engagement members 10*c* of the cover member 10 for positioning.

Figure 4:
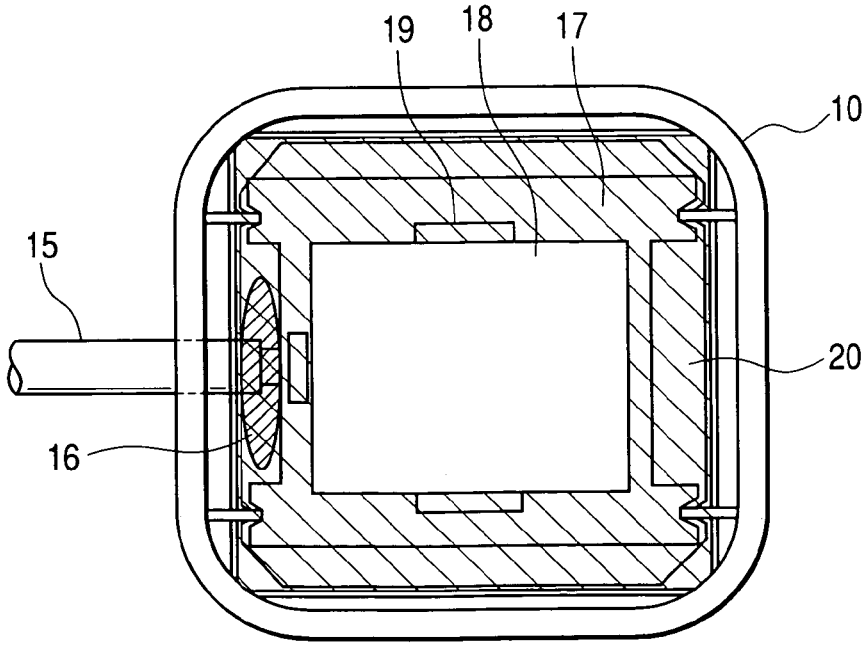
FIG. 4 is a bottom view of the GPS receiving antenna after a seal part is formed.
Figure 5A:
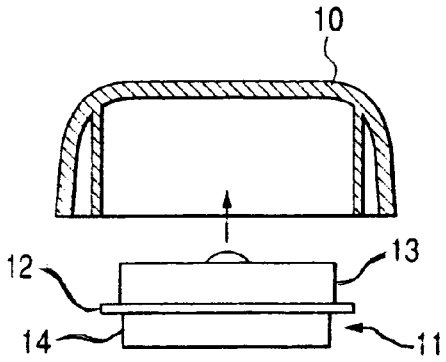
FIG. 5(*a*) is a schematic sectional view showing the process of attaching an antenna module.
Figure 5D:
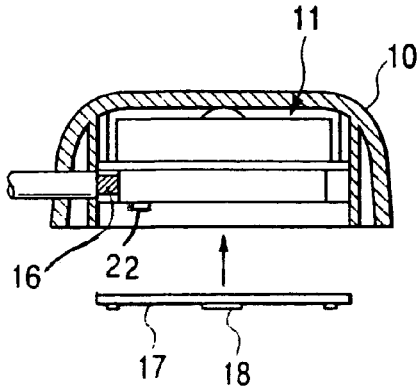
Figure 5B:
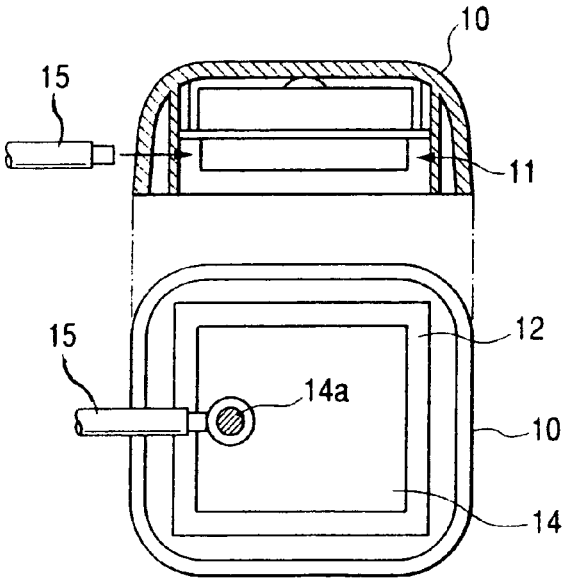
Figure 5E:
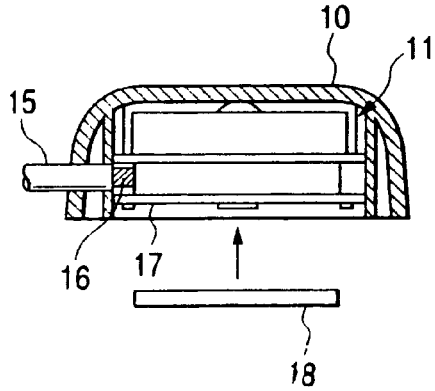
Figure 5C:
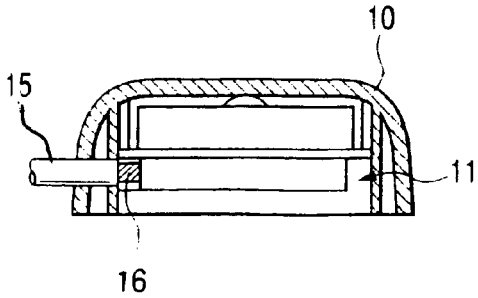
Figure 5F:
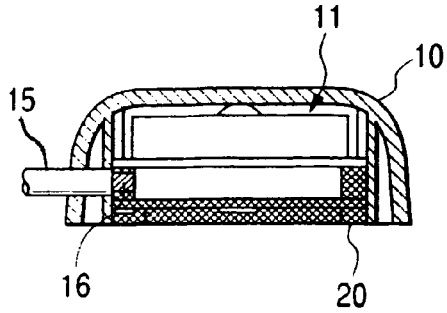
Figure 6:
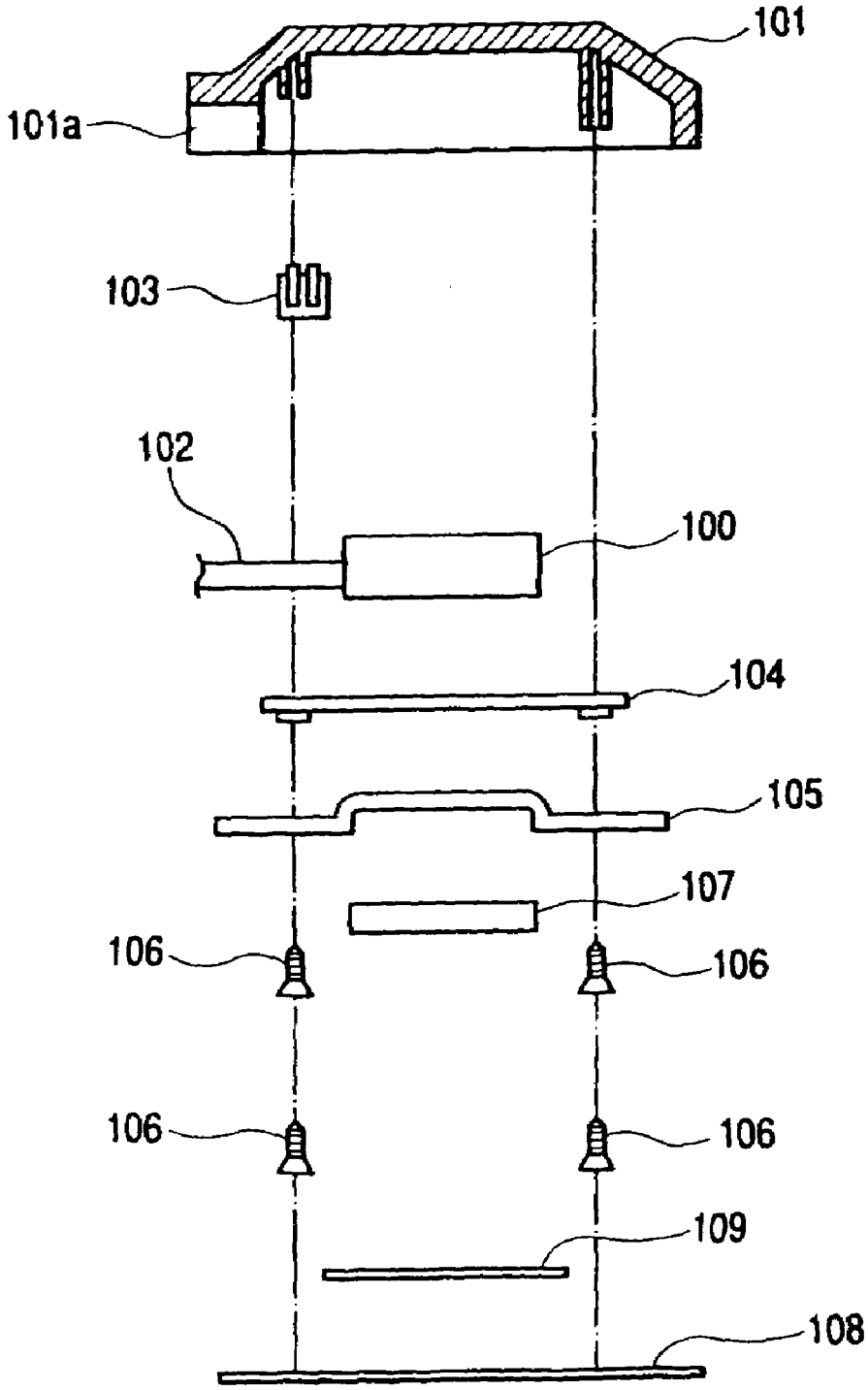
FIG. 6 PRIOR ART
FIG. 6 is an exploded side view of a conventional antenna device.

The GPS receiving antenna 1 includes the magnet 18 and can surely be fixed to the roof of an automobile by the magnetic force of the magnet 18. Note that the GPS receiving antenna 1 may be fixed to the automobile by another fixing member rather than using the magnet 18, but the antenna fixed by the magnet 18 can be detached/attached from/to the automobile extremely easily. In the GPS receiving antenna 1, the shape and number of the magnets 18 are not particularly specified. As shown in FIG. 4, in the GPS receiving antenna 1, the cover member 10 has its open surface closed by the metal plate 17 and the magnet 18 as the antenna module 11 is stored in the internal space or the cover member 10, and the seal part 20 filled with a composite resin material is formed. Note that in FIGS. 2 and 4, the part where the seal part 20 is formed by filling the composite resin material is diagonally shaded. The seal part 20 is made of a composite resin material such as polyester polymer filled and solidified by hot melt process and the seal part encloses the antenna module 11 in the internal space of the cover member 10.

In the GPS receiving antenna 1, the seal part 20 is formed in this way, so that high water resistance is secured and the antenna module 11 can be prevented from degrading such as rusting if it is exposed to the weather for a long period of time.

The GPS receiving antenna 1 is made waterproof by the seal part 20 filled with the composite resin material. Therefore, the antenna has a considerably reduced number of parts and a simplified structure as compared to the conventional GPS receiving antenna. Consequently, the parts cost and assembly cost can considerably be reduced and the overall cost can be reduced. Note that any arbitrary material other than polyester polymer may be used as the composite resin material to form the seal part 20 in consideration of how easily the material can be solidified and the fluidity of the material when the material is melted as long as desired water resistance can be secured.

The seal part 20 does not have to be filled and solidified by the hot malt process, while the process is desirably employed in view of readiness in filling or the necessary man hours. The open wide (side facing the outside) of the cover member 10 in the seal part 20 is preferably formed to be flat. In this way, the antenna is easily provided on a relatively flat surface such as on the roof of an automobile.

FIG. 4 shows an example of how the magnet 18 is set in the seal part 20 while the bottom of the magnet 19 faces the outside from the seal part 20, but the magnet 18 may completely be surrounded by the seal part 20. In this way, the water resistance by the seal part 20 can be improved. However, in consideration or the fixing strength of the magnet 19 to the surface by the magnetic force of the magnet 18, it is Preferable that the bottom of the magnet 18 is exposed through the seal part 20.

The GPS receiving antenna 1 may be provided with a sheet type member 21 in approximately the same shape au the bottom of the cover member 10 on the outer side of the seal part 20 as shown in FIG. 2 in order to prevent the roof of the automobile from being damaged by the magnet 18 or the like exposed at the bottom. The sheet type member 21 may be formed for example by polyethylene terephthalate (PET). In this case, an identifier tag similar to that of the conventional GPS receiving antenna may be provided between the seal part 20 and the sheet type member 21, so that the content inscribed on the identifier tag may be read through the transparent part formed on the sheet type member 21.

The method or assembling the GPS receiving antenna 1 will be described. FIGS. 5(*a*) to 5(*r*) show a series of steps in the assembling process. In producing the GPS receiving antenna 1, the antenna module 11 is stored and fitted in the case member 10 as shown in FIG. 5(*a*). Then, as shown in FIG. 5(*b*), the transmission cable 15 is inserted from the hole 10*b* of the case member 10 and soldering is carried out. The soldering is carried out in a working hole 14*a* provided in the shield case 14 corresponding to the connection part between the substrate 12 and the transmission cable 15.

Now, as shown in FIG. 5(*c*), silicon resin is filled around the connected transmission cable 15 in the vicinity of the hole 10*b* of the case member 10, and the seal member 16 is formed. Then, as shown in FIG. 5(*d*), the metal plate 17 is attached to the shield case 14 with a length of double-faced adhesive tape 22, and as shown in FIG. 5(*e*), the magnet 18 is attached to the metal plate 17 by the magnetic force as it is positioned by the protrusions 19 of the metal plate 17. Finally, as shown in FIG. 5(*f*), a hot melt adhesive or the like is filled within the open side of the case member 10 to form the seal part 20, and the GPS receiving antenna 1 is completed.

What is claimed is:

1. An antenna device, comprising an antenna upper housing member defining a chamber having a lower opening, and formed with a cable hole;

an antenna module, adapted to receive a radio wave, arranged in said chamber;

a signal cable, extending through said cable hole into the chamber and connected to the antenna module;

an antenna lower housing member arranged under the antenna module and arranged to at least partially close said lower opening;

a cable-sealing member, filling a space between the cable hole and an outer periphery of the signal cable;

a housing sealing and securing material covering at least a portion of said antenna lower housing member and adhering the antenna lower housing member and the antenna upper housing member while fully closing the lower opening.

2. The antenna device of claim 1, wherein the cable-sealing member includes a silicon resin.

3. The antenna device of claim 1, wherein:

the antenna lower housing member has a magnet supporting structure which supports a magnet;

the housing sealing and securing member secures the magnet to the antenna lower housing member;

the antenna module has a receiving antenna adapted to receive the radio wave, and a shield case formed of a material attracted by the magnet;

the antenna lower housing member is formed, at least in part, of a material attracted by the magnet;

the magnet is magnetically connected to the shield case thereby securing the antenna lower housing member to the antenna module; and the magnet supporting structure includes a plurality of projections constructed and arranged for positioning the magnet.

4. The antenna device of claim 1, wherein the housing sealing and securing material includes a composite resin.

5. A method of making an antenna unit comprising:

providing an upper antenna housing forming a chamber having a lower opening, the housing formed with a cable hole;

inserting an antenna module through the lower opening into the chamber, the antenna module having an antenna for receiving radio waves;

passing a cable through said cable hole into the chamber and connecting the cable to the antenna module;

inpouring a cable-sealing material into a space between the cable hole and an outer periphery of the signal cable so as to fill the space;

hardening the cable-sealing material filled in the space;

providing a lower antenna housing to substantially cover said lower opening under said antenna module;

inpouring a sealing and securing material on at least a portion of the lower antenna housing; and hardening the sealing and securing material thereby adhering the antenna lower housing member and the antenna upper housing member while fully closing the lower opening.

6. The method of claim 5, wherein at least a region of the hardened sealing and securing material forms a lower surface for supporting the antenna unit on an external object.

7. The method of claim 5, further comprising:

accommodating the antenna module with a shield case;

providing a magnet supporting structure adapted to support a magnet on the antenna lower housing member;

providing a magnet; and magnetically connecting the magnet to the shield case thereby securing the antenna lower housing to the antenna module, wherein:

the magnet is secured to the antenna lower housing by the hardened sealing and securing material; and at least a portion of a lower surface of the magnet is not covered by the hardened sealing and securing material.

8. The method of claim 5 further comprising:

adhering the lower antenna housing to the antenna module in the upper antenna housing prior to inpouring the sealing and securing material.

9. The method of claim 8, wherein said adhering the lower antenna housing to the antenna module is performed by two-faced adhesive tape between a lower surface of the antenna module and an upper surface of said lower antenna housing.

10. The method of claim 5, wherein the sealing and securing material includes a composite resin.

* * * * *